United States Patent [19]

O'Neil

[11] Patent Number: 4,503,933

[45] Date of Patent: Mar. 12, 1985

[54] BUILDING EVACUATION DEVICE

[76] Inventor: Michael J. O'Neil, 16335 Arena Dr., Ramona, Calif. 92065

[21] Appl. No.: 567,404

[22] Filed: Dec. 30, 1983

[51] Int. Cl.[3] ..... A62B 1/08

[52] U.S. Cl. ..... 182/231; 182/236

[58] Field of Search ..... 182/231, 235, 3, 5–7, 182/236, 240, 18, 19

[56] References Cited

U.S. PATENT DOCUMENTS

| | | | |
|---|---|---|---|
| 437,091 | 9/1890 | Carr | 182/240 |
| 719,646 | 2/1903 | Casanova | 182/240 |
| 1,574,529 | 2/1926 | Abraham | 182/7 |
| 3,392,380 | 7/1968 | Fordyce | 182/18 |
| 3,844,377 | 10/1974 | Wilkins | 182/6 |
| 4,010,822 | 3/1977 | Banner | 182/18 |
| 4,024,928 | 5/1977 | Pickard | 182/19 |

*Primary Examiner*—Reinaldo P. Machado

*Attorney, Agent, or Firm*—Charmasson & Holz

[57] ABSTRACT

An emergency device which is stowed into a compact enclosure attached to the lintel of an upper-story window to facilitate evacuation in case of fire. The device comprises a windlass upon which is coiled a sturdy web supporting a body harness. The unrolling of the web is restrained by a powerful brake mechanism which can be controllably released by means of a handle associated with the harness. The control cable which connects the handle to the brake mechanism is coiled alongside the web and is unrolled at the same pace; thus giving the user continuous hand control of the brake release during the whole descent.

10 Claims, 11 Drawing Figures

BUILDING EVACUATION DEVICE

FIELD OF THE INVENTION

This invention relates to windlasses, winches, and more particularly to those used in connection with emergency and rescue operations. The invention also relates to brakes and other release mechanisms designed to control the unwinding of lines or cables from such devices.

BACKGROUND OF THE INVENTION

Recent history has demonstrated that fires in structures which are densely occupied such as office buildings and hotels exert a nigh toll on human life. The widespread use of synthetic material for construction and decorations of these types of buildings results in a high level of toxic smoke which quickly invades the normal evacuation routes such as stairwells and elevator shafts; leaving the outside windows as the only way to escape. A jump from a window above the third or fourth floor is often fatal. Fireman ladders, in most cases, cannot reach beyond the fifteenth floor. Accordingly, there is a need for an evacuation device which could be quickly lowered from an upper story window. Such a device should be operable by an unskilled person with no prior training and should provide a reasonable degree of safety without being cumbersome, intricate or expensive to fabricate, install and maintain. The descent by means of such a device should be totally controllable at the discretion of the user in order to increase his feeling of safety and decrease any risk of panic and uncontrolled reflexes. The evacuation device should be compact and attractively packaged and not substantially affect the architectural character of the building.

SUMMARY OF THE INVENTION

The principal object of this invention is to provide a window evacuation device which can be safely operated by a building occupant to lower himself to the ground in case of fire or other type of emergency situation where the normal exit routes cannot be used.

Another object of this invention is to provide such a device with a simple reliable control mechanism which lets the user regulate the pace of descent.

A further object of the invention is to provide a means for mounting and stowing such an evacuation device in an inconspicuous or attractive enclosure where it can be easily accessed for maintenance or use.

These and other valuable objects are achieved by means of a windlass on which is coiled a sturdy web supporting a body harness. The Windlass is restrained by a powerful brake mechanism which is operated by the user through a line which is also coiled on the windlass so that the line and the web are unrolled as the same pace to maintain the control accessible to the user throughout the descent. The whole mechanism is packaged in an attractive enclosure attached permanently to the lintel of the window.

DESCRIPTION OF THE PREFERRED EMBODIMENT OF THE INVENTION

Figure 1:
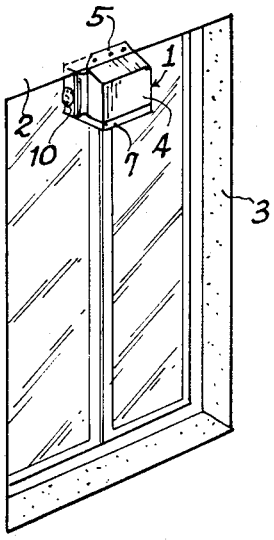
FIG. 1 is perspective view of the emergency evacuation device installed against the lintel of the inside casing of the window.
Figure 2:
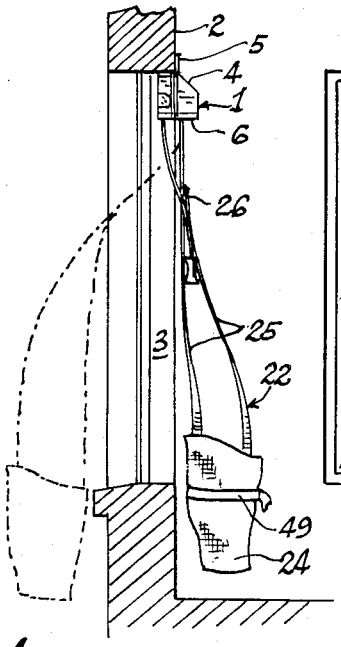
FIG. 2 is a side view of the device with its cover removed showing the deployed harness.
Figure 3:
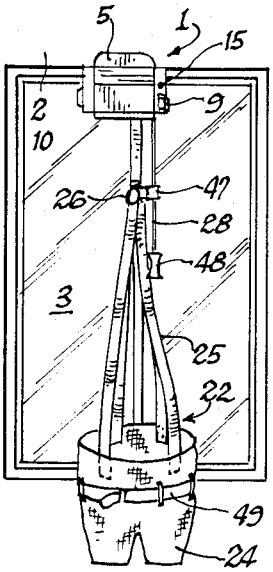
FIG. 3 is a front view thereof.
Figure 4:
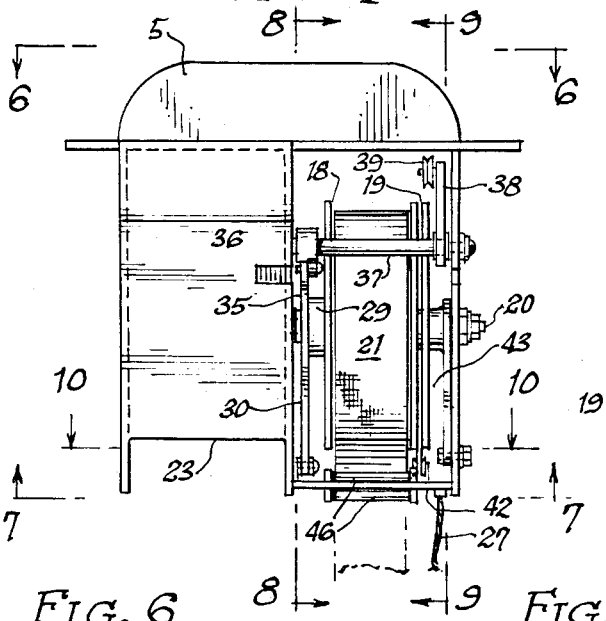
FIG. 4 is a front view of the windlass mechanism.
Figure 5:
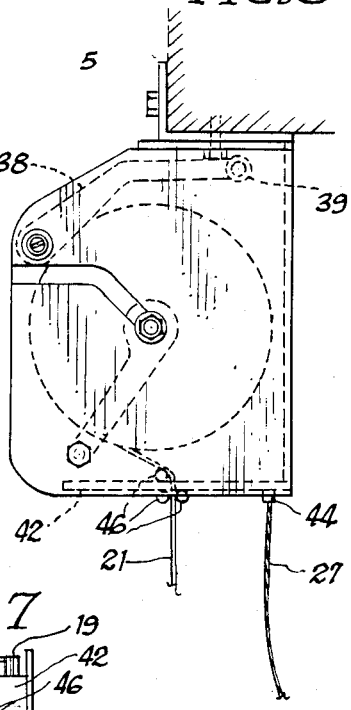
FIG. 5 is a right side view thereof.
Figure 6:
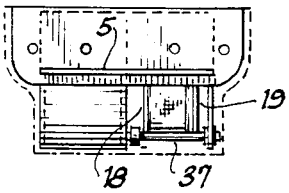
FIG. 6 is a top plan view thereof.
Figure 7:
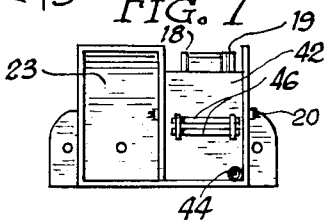
FIG. 7 is a bottom plan view thereof.
Figure 8:
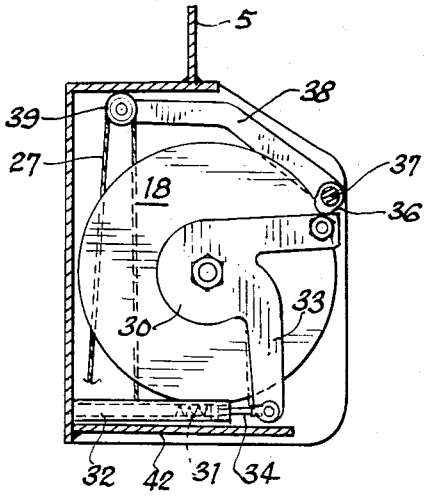
FIG. 8 is a cross-sectional view taken along line 8—8 of FIG. 4.
Figure 9:
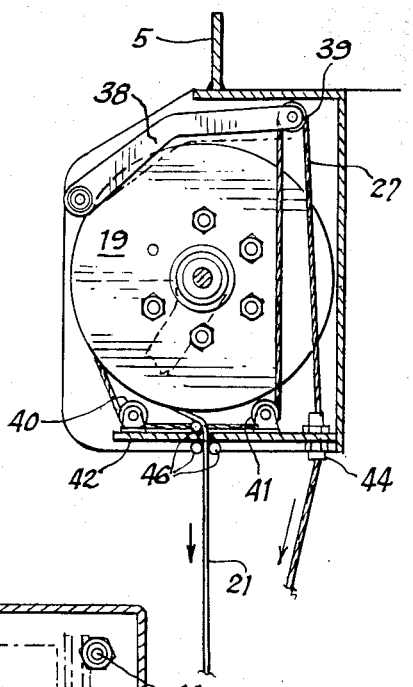
FIG. 9 is a cross-sectional view taken along line 9—9 of FIG. 4.
Figure 10:
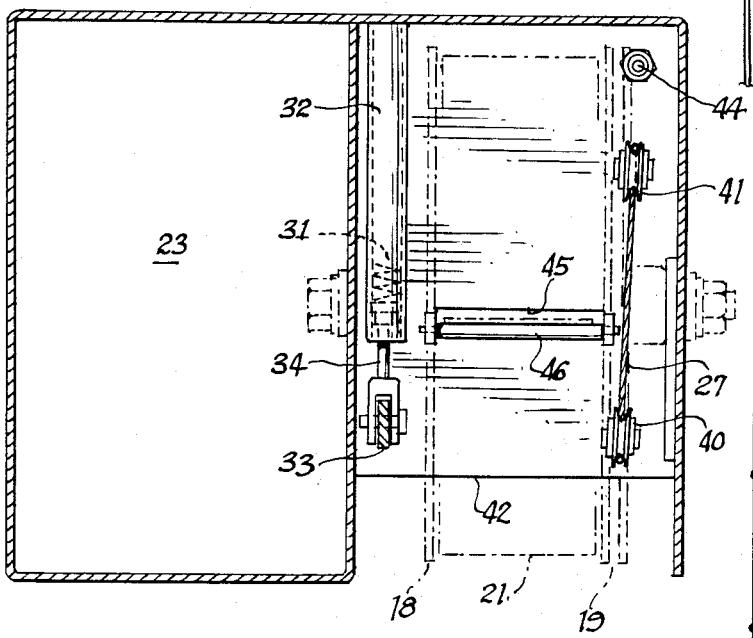
FIG. 10 is a cross-sectional view taken along line 10—10 of FIG. 4.
Figure 11:
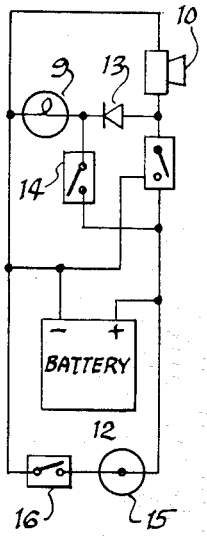
FIG. 11 is an electrical schematic of the smoke alarm and light system.

Referring now to the drawing, there is shown in FIG. 1 through 3 a building evacuation device 1 installed against the lintel 2 of the inside casing of a window 3. The device is packaged in an enclosure 4 supported by an angle bracket 5 which is secured to the window lintel 2. The enclosure 4 has a bottom opening 6 which is normally sealed by a removable cover 7 shown in FIG. 1 only. On the left side of the enclosure is installed a smoke detector 8. On the right side of the enclosure is light 9 designed to illuminate the room during the emergency evacuation of the room. The operation of the smoke detector and light can be better understood with reference to the schematic of FIG. 11.

When smoke is detected, a switch closure 11 in the smoke detector 8 applies the current from a battery 12 to an alarm horn 10, and via diode 13 to the light 9. The light will also be energized through a microswitch 14 which closes upon opening or removal of the cover 7. The charge status of the battery 12 is constantly monitored by a LED indicator 15 mounted in series with a periodical interruptor 16 which causes the indicator 15 to flash briefly every 40 seconds. The indicator is mounted on the right side of the enclosure 4 for easy viewing.

When the cover 7 is removed a harness assembly 22 falls toward the floor as better shown in FIGS. 2 and 3. This harness assembly is designed to allow a person, who needs to evacuate the room through the window 3 in case of emergency, to lower himself under his own control toward the ground below. The descent is controlled by a windlass 17 the operation of which is illustrated in FIGS. 4 through 10.

The windlass 17 groups two reels 18 and 19 side-by-side on a single shaft 20. Wound on reel 18 is a web 21 whose free end attaches to the harness assembly 22. The harness is normally stowed in a storage compartment 23 open at the bottom to allow it to fall to the ground as soon as the cover is removed. The harness comprises a high-waisted pair of pants 24 remade of heavy fabric supported by two pairs of straps 25 which converge toward a ring 26 tied to the end of the web 21. The pants 24 are provided with a belt 49 to cinch the upper part firmly around the user's body. Additionally, belts are installed around each leg of the pants 24 in order to cinch them tightly and thus take some of the user's weight and relieve some of the pressure against his groin. On the adjacent reel 19 is coiled a cable 27 having its free end 28 dangling in the proximity of the harness assembly 22. The cable 27 is terminated by a handle 48 which is pulled by the user to activate the windlass 17.

The object of the invention being to allow the user of the harness to control his own rate of descent, the windlass 17 is designed so that it will not unwind the web 21 except under the control of the user, as will be made clear by the following description of the windlass mechanism.

In the hub 29 of reels 18 and 19 is a friction brake (not illustrated) which is similar to the coaster brake used in the rear wheel of some bicycles. This type of coaster brake is characterized by the fact that any backward pedaling transmitted to the rear wheel by the bicycle chain causes an eccentric drum to apply friction against the inside wall of the rear wheel hub. In this embodiment a two-armed lever 30 fulfills the same function as the rear wheel sprocket in a bicycle, and provides the rearward tortional force necessary to activate the brake. The braking force is applied by a coil spring 31 which has been compressed into a tubular enclosure 32. The spring 31 applies a braking force on arm 33 through rod 34. The coil spring 31 in combination with arm 33 applies approximately 5,500 kilograms per centimeter (118 foot pounds) of torque against the unrolling movement of reels 18 and 19. This torque is sufficient to support a weight of 250 kilograms (550 pounds) in the harness 22 without causing the web to unroll.

The brake is released by applying a counter force against spring 31 through arm 35. This counter force is exerted by a cam 36 mounted on shaft 37 in front of reels 18 and 19. Shaft 37 is rotated by means of a lever 38. Lever 38 projects backward toward the rear of the device and mounts at its free end a pulley 39 upon which is engaged the cable 27 coming out of reel 19.

When cable 27 is unwound from reel 19 it is first captured by two pulleys 40 and 41 on the bottom plate of the reel compartment 43. Pulley 41 is not lined up with pulley 40 but offset slightly to the right so that the cable 27 exists pulley 41 to the right of reel 19 to engage pulley 39 at the end of lever 38. Cable 27 then descends toward the harness, exiting the reel compartment 43 through sleeve 44. It can be now understood that with the reels 18 and 19 immobilized by the brake mechanism, pulling the end 28 of cable 27 will cause lever 38 to be pulled down due to the non-linear path followed by the cable 27. This action will in turn exert the counter force necessary to release the brake through shaft 37, cam 36 and arm 35 of the brake mechanism.

As the web 21 unrolls it passes through a slot 45 in the bottom plate 42 of the reel enclosure. The web is guided around the slot 45 by a three roller assembly 46. The roller assembly prevents the web 21 from twisting, folding upon itself or being frayed as it passes through the slot 45.

As the web 21 unrolls so does the cable 27 and at the same pace. Accordingly, the end 28 of the cable 27 remains in close proximity to the harness 22 during the whole descent. In order to achieve this result care must be taken that the thickness of the cable 27 be equal to the thickness of the web 21. One could also select a cable whose diameter is twice the thickness of the web 21; but in such case, two loops of cable must be coiled side-by-side on reel 19 for each loop of the web 21, in order that both the web 21 and the cable 27 unwind at the same pace. In other words, the number of cable loops for each loop of the web should be approximately equal to the ratio of the cable cross-diameter over the web thickness.

The end 28 of the cable 27 is passed through a loop 47 attached to the upper section of the harness 22 in order to keep the handle 48 which terminate the cable in close proximity to the user at about shoulder height.

It can now be understood that the windlass will unroll the web 21 only when the handle 48 at the end of cable 27 is pulled. Releasing the pull of the cable will automatically reapply the brake and immediately stop the descent.

Additional safety may be introduced into the operation of the windlass 17 by installing a ratchet drive in the connection of lever 38 to shaft 37; and substituting a spur wheel for the cam 36. With this modification, each pull on the cable 27 will allow the web to be unwound for a discrete short amount; requiring a repeated pumping action on the handle 48 to continue the descent.

While the preferred embodiment of the invention has been described, modification could be made and other embodiments could be devised without departing from the spirit of the invention and within the scope of the appended claims.

What is claimed is:

1. An apparatus allowing its user to safely control his escape and descent from an upper floor window or the like, which comprises:

a reel;

a first line coiled from one end on the reel;

means for attaching the other end of said line to the user's body;

a coaster-type brake installed in the hub of said reel;

means for resiliently applying said brake against the line-unrolling movement of the reel;

a hand-operated means for releasing the brake; and means for keeping said hand operated means accessible to the user during said descent.

2. The apparatus claimed in claim 1 wherein said means for keeping said hand-operated means accessible comprises:

a second line coiled on said reel from one end, the other end of said second line engaging said means for releasing the brake, then extending downward to the level of said means for attaching where it is accessible to the user during said descent.

3. The apparatus claimed in claim 4 wherein said means for resiliently applying said brake comprises a compressed coil spring biased against one arm of said brake.

4. The apparatus claimed in claim 3 wherein said means for exerting a releasing force comprises:

a cam;

a shaft engaging said cam;

a lever acting upon said shaft;

the end of said lever being slidingly engaged by said second line; and said cam being shaped, dimensioned and positioned on said brake to cause compression of the coil spring when said lever is deflected under the pull of the second line.

5. The apparatus claimed in claim 4 wherein said second line follows a non-linear path to engage the end of said lever before extending downward to said means for attaching.

6. The apparatus claimed in claim 4 wherein said coaster-type brakes includes a plate having two arms;

said plate being coupled to said coaster-type brake;

the first of said arms receiving a torquing force from said spring; and the second of said arms receiving a torquing force in the opposite direction from said cam.

7. The apparatus claimed in claim 4 which further comprises:

a smoke alarm;

a horn;

a light; and means, responsive to said smoke alarm, to energize said horn and said light upon detection of smoke.

8. The apparatus claimed in claim 1 wherein said means for attaching comprises a body harness attached to the end of said first line.

9. The apparatus claimed in claim 8 wherein said body harness comprises:

a pair of pants; and a plurality of straps to attach said pants to the end of the first line.

10. The apparatus claimed in claim 8 which further comprises an enclosure having a cavity shaped and dimensioned to house said harness.

* * * * *